US008608872B2

(12) United States Patent
Kondo et al.

(10) Patent No.: US 8,608,872 B2
(45) Date of Patent: Dec. 17, 2013

(54) HIGH-STRENGTH STAINLESS STEEL PIPE EXCELLENT IN SULFIDE STRESS CRACKING RESISTANCE AND HIGH-TEMPERATURE CARBONIC-ACID GAS CORROSION RESISTANCE

(75) Inventors: Kunio Kondo, Sanda (JP); Hisashi Amaya, Kyoto (JP); Hideki Takabe, Osaka (JP); Taro Ohe, Takaishi (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 22 days.

(21) Appl. No.: 13/082,432

(22) Filed: Apr. 8, 2011

(65) Prior Publication Data

US 2011/0226378 A1 Sep. 22, 2011

Related U.S. Application Data

(63) Continuation of application No. PCT/JP2009/068518, filed on Oct. 28, 2009.

(30) Foreign Application Priority Data

Oct. 30, 2008 (JP) ..... 2008-279014

(51) Int. Cl.
*C22C 38/42* (2006.01)
*C22C 38/44* (2006.01)

(52) U.S. Cl.
USPC ..... 148/325; 148/909; 420/61

(58) Field of Classification Search
USPC ..... 148/325, 909; 420/61
See application file for complete search history.

(56) References Cited

FOREIGN PATENT DOCUMENTS

| | | |
|---|---|---|
| CA | 2 509 581 | 7/2004 |
| CN | 1836056 | 9/2006 |
| EP | 1 652 950 | 5/2006 |
| JP | 03-075335 | 3/1991 |
| JP | 07-166303 | 6/1995 |
| JP | 09-291344 | 11/1997 |
| JP | 10-025549 | 1/1998 |
| JP | 11-350081 | 12/1999 |
| JP | 2001-164341 | 6/2001 |

(Continued)

OTHER PUBLICATIONS

Machine-English translation of Japanese patnet 2005-336599, Dec. 8, 2005, Kimura Mitsuo et al.*

*Primary Examiner* — Deborah Yee
(74) *Attorney, Agent, or Firm* — Clark & Brody

(57) ABSTRACT

The problem to be solved is the provision of a high-strength stainless steel pipe having a sufficient corrosion resistance in a high-temperature carbonic acid gas environment and having an excellent sulfide stress cracking resistance at normal temperature. A high-strength stainless steel pipe consist of, by mass %, C: 0.05% or less, Si: 1.0% or less, P: 0.05% or less, S: less than 0.002%, Cr: more than 16% and 18% or less, Mo: more than 2% and 3% or less, Cu: 1% to 3.5%, Ni: 3% or more and less than 5%, Al: 0.001% to 0.1% and O: 0.01% or less, Mn: 1% or less and N: 0.05% or less, and Mn and N in the above ranges satisfy formula (1), and the balance being Fe and impurities; and the metal micro-structure of the stainless steel pipe mainly includes a martensitic phase and comprises 10 to 40% of a ferritic phase by volume fraction and 10% or less of a retained γ-phase by volume fraction.

$$[Mn]\times([N]-0.0045)\leq 0.001 \quad (1)$$

wherein the symbols of elements in formula (1) respectively represent the contents (unit: mass %) of the elements in the steel.

4 Claims, 1 Drawing Sheet

(56) References Cited

FOREIGN PATENT DOCUMENTS

| | | |
|---|---|---|
| JP | 2002-004009 | 1/2002 |
| JP | 2004-107773 | 4/2004 |
| JP | 2005-105357 | 4/2005 |
| JP | 2005-336595 | 12/2005 |
| JP | 2005-336599 | 12/2005 |
| JP | 2006-016637 | 1/2006 |
| JP | 2006-307287 | 11/2006 |
| JP | 2007-146226 | 6/2007 |
| JP | 2007-169776 | 7/2007 |
| JP | 2007-332431 | 12/2007 |
| JP | 2007-332442 | 12/2007 |
| JP | 2008-081793 | 4/2008 |
| WO | 96/38597 | 12/1996 |
| WO | 2004/001082 | 12/2003 |

* cited by examiner

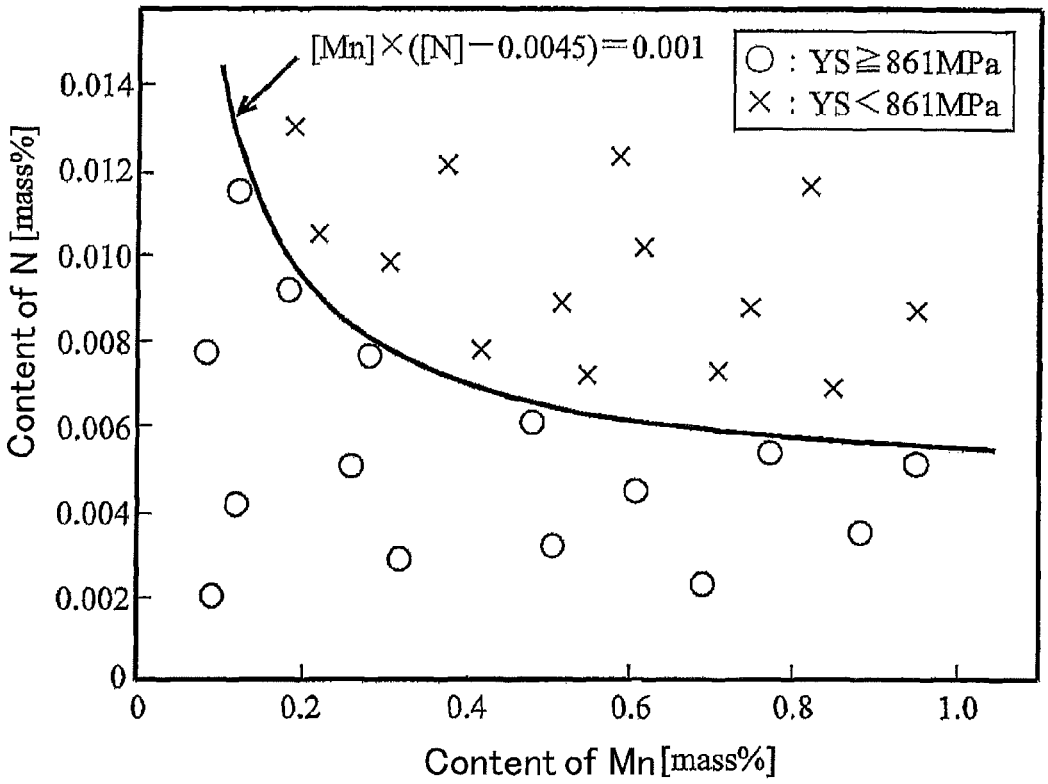
[Mn]×([N]−0.0045)=0.001
○ : YS≧861MPa
× : YS<861MPa
Content of N [mass%]
0.014
0.012
0.010
0.008
0.006
0.004
0.002
0
0
0.2
0.4
0.6
0.8
1.0
Content of Mn [mass%]

HIGH-STRENGTH STAINLESS STEEL PIPE EXCELLENT IN SULFIDE STRESS CRACKING RESISTANCE AND HIGH-TEMPERATURE CARBONIC-ACID GAS CORROSION RESISTANCE

The disclosure of International Application No. PCT/JP2009/068518 filed Oct. 28, 2009 including specification, drawings and claims is incorporated herein by reference in its entirety.

TECHNICAL FIELD

The present invention relates to a stainless steel pipe having a high strength, in particular, a stainless steel pipe or a line pipe for use in oil well, used for oil well producing crude oil or gas well producing natural gas; in particular, the present invention relates to a stainless steel pipe having an excellent corrosion resistance and a high strength, suitable for use in oil well or gas well in a severe high-temperature corrosive environment containing hydrogen sulfide gas, carbonic acid gas and chloride ions.

BACKGROUND ART

For oil wells and gas wells in environments containing carbonic acid gas, it has been common to use 13% Cr martensitic stainless steel pipes excellent in carbonic-acid gas corrosion resistance. However, recent increasing depth of oil wells and gas wells (hereinafter, abbreviated as oil wells) requires materials higher in strength than has hitherto been required. The oil well environment is such that as the depth of the oil well is increased, the environment becomes higher in temperature and pressure, and higher in the partial pressures of carbonic acid gas and hydrogen sulfide. Therefore, steel pipes having sufficient corrosion resistance even in severer environments come to be needed.

Since the corrosiveness of carbonic acid gas at high temperatures is generally controlled by the content of Cr, a composition design for further increasing the content of Cr is required for the purpose of improving the corrosion resistance of a steel pipe. However, when the content of Cr is increased, generally δ-ferrite is produced, and accordingly no martensitic single-phase micro-structure comes to be obtained and the strength and the toughness are deteriorated. Therefore, in oil wells requiring high strength, two-phase stainless steel pipes produced by cold working have been frequently used. However, unfortunately, the two-phase stainless steel pipes contain large amounts of alloying elements and further require a special production step of cold working, and hence the two-phase stainless steel pipes are not such materials that can be offered inexpensively.

Accordingly, recently, there have been investigated steel pipes in which martensitic stainless steel is taken as the base material, and the amount of Cr is further increased as compared to conventional steel pipes. Examples of such investigations include Patent Documents 1 to 16.

Patent Document 1: JP3-75335A
Patent Document 2: JP7-166303A
Patent Document 3: JP9-291344A
Patent Document 4: JP2002-4009A
Patent Document 5: JP2004-107773A
Patent Document 6: JP2005-105357A
Patent Document 7: JP2006-16637A
Patent Document 8: JP2005-336595A
Patent Document 9: JP2005-336599A
Patent Document 10: WO2004/001082

Patent Document 11: JP2006-307287A
Patent Document 12: JP2007-146226A
Patent Document 13: JP2007-332431A
Patent Document 14: JP2007-332442A
Patent Document 15: JP2007-169776A
Patent Document 16: JP10-25549A

DISCLOSURE OF THE INVENTION

Problems to be Solved by the Invention

The above-described patent documents give no specific disclosure of steels or steel pipes satisfying all the following conditions (1) to (3) corresponding to very deep oil wells or gas wells.

(1) High strength is essential.

(2) Sufficient corrosion resistance is maintained even in a carbonic acid gas environment at a temperature as high as 200° C.

(3) Sufficient sulfide stress cracking resistance is maintained even when the environmental temperature of the oil well or the gas well is decreased by temporal suspension of the collection of crude oil or gas.

Accordingly, the present inventors have investigated the component composition of a stainless steel which simultaneously satisfies the above-described three conditions (high strength, sufficient corrosion resistance in a high-temperature carbonic acid gas environment, sufficient sulfide stress cracking resistance). Specifically, first, for the purpose of being capable of ensuring sufficient corrosion resistance even in a carbonic acid gas environment at a high temperature (for example, 200° C.), the investigation of the alloy composition of the stainless steel has been performed. Consequently, it has been discovered that the content of Cr is most important for the purpose of ensuring the corrosion resistance of stainless steel. Additionally, the present inventors have also discovered that it is necessary to contain a certain amount of Mo in the stainless steel for the purpose of ensuring sufficient sulfide stress cracking resistance.

In this connection, it has hitherto been customary to aim at a metal micro-structure of a martensitic single phase, for the purpose of ensuring the high strength and the high toughness of stainless steel. However, according to the various investigations of the present inventors, it has been revealed that the addition of a considerably large amount of Ni is required in a stainless steel having a component system that contains Cr in a high content and contains Mo, for the purpose of aiming at a martensitic single phase at normal temperature and an austenitic single-phase system at the time of hot working or at the start of quenching. Additionally, it has been newly revealed that the addition of a large amount of Ni drastically increases the retained γ-phase in proportion and accordingly the ensuring of the strength becomes rather difficult.

Accordingly, the present inventors have investigated the component system of a stainless steel capable of satisfying the strength, toughness and corrosion resistance although the component system is not a martensitic single-phase system. Specifically, δ-ferrite was positively utilized, and on the basis of δ-ferrite, investigation was made on the ensuring of a strength as high as conventional strengths and on the further improvement of the corrosion resistance. Consequently, it has been revealed that by utilizing the precipitation strengthening effect through the addition of Cu, the strength can be ensured and additionally the corrosion resistance is also improved.

Additionally, Ni is also an element that improves the corrosion resistance, and addition of a larger amount of Ni can improve the corrosion resistance; however, the addition of a larger amount of Ni decreases the Ms point, namely, the martensitic transformation point temperature. Consequently, the retained γ-phase becomes larger in proportion and is stabilized, and hence the strength of the stainless steel is drastically deteriorated. Therefore, the present inventors have made various investigations on the basis of the idea that if the deterioration of the strength can be suppressed by increasing the Ms point, Ni can be effectively utilized. Consequently, it has been revealed that if no certain constraints are imposed on the content of N and the content of Mn, the decrease of the Ms point due to the addition of Ni cannot be suppressed and the aimed high strength cannot be obtained. From the results of this investigation, the present inventors have discovered that limitation of the content of N and the content of Mn enables each of Cr, Mo, Cu and Ni to be added in a largest possible amount, and the high strength and the high corrosion resistance of the stainless steel pipe can be made compatible with each other.

Accordingly, an object of the present invention is to provide a stainless steel pipe which has a high strength that can cope with very deep oil well or gas well, has a sufficient corrosion resistance even in a carbonic acid gas environment at a temperature as high as 200° C., and has a sufficient sulfide stress cracking resistance even when the environmental temperature of the oil well or the gas well is decreased by temporal suspension of the collection of crude oil or gas.

It is to be noted that in the present invention, the statement that "a sufficient corrosion resistance is maintained even in a high-temperature carbonic acid gas environment" means the fact that in a high-temperature carbonic acid gas environment containing chloride ions, an excellent corrosion resistance is exhibited against the stress corrosion cracking. Specifically, the statement means that even in such a severe environment that the temperature is about 200° C., a corrosion resistance capable of suppressing the occurrence of the stress corrosion cracking is maintained. Additionally, the term "sufficient sulfide stress cracking resistance" means that in an oil well (gas well) environment that contains a trace of hydrogen sulfide, an excellent resistance is maintained against the cracking phenomenon due to hydrogen brittleness and an excellent corrosion resistance performance is maintained against the cracking phenomenon that is high in sensitivity at around normal temperature. Additionally, the term "a high-strength stainless steel pipe" refers to a high-strength stainless steel pipe having a yield strength of 758 MPa (110 ksi) or more and more preferably 861 MPa (125 ksi) or more.

Means for Solving the Problems

First, the present inventors have performed an investigation on the alloy composition of stainless steel for the purpose of ensuring a sufficient corrosion resistance of a stainless steel pipe even in a carbonic acid gas environment at a high-temperature (for example, 200° C.). Consequently, the present inventors have discovered that the content of Cr is most important for the purpose of ensuring the corrosion resistance of stainless steel and the content of Cr is required to exceed 16%.

Next, in a material (stainless steel) of a component system having a content of Cr more than 16%, the effect of other alloying elements has been investigated from the viewpoint of ensuring the strength. First, an investigation on Ni as one of the other alloying elements was performed. In a 13Cr material, Ni usually stabilizes the austenitic phase at high temperatures. The austenitic phase stabilized by Ni at a high temperature is transformed into a martensitic phase by a subsequent heat treatment (cooling treatment). Consequently, a high-strength stainless steel is obtained.

However, various investigations performed by the present inventors have revealed that an addition of a larger amount of Ni is required for the purpose of forming an austenitic single phase at a high temperature in a stainless steel having a content of Cr more than 16%. Additionally, it has also been revealed that the addition of a larger amount of Ni decreases the Ms point, which is the martensitic transformation initiation temperature, down to the vicinity of room temperature and the austenitic phase becomes stable close to room temperature, and hence no martensitic phase is obtained, and the strength of the stainless steel is drastically deteriorated. From this investigation result, the present inventors have discovered that the content of Ni is required to be limited in order to prevent the decrease of the Ms point. Specifically, for the purpose of setting the Ms point at a temperature sufficiently higher than room temperature, the content of Ni is required to be limited to less than 5%.

On the other hand, when the content of Ni is limited to less than 5%, a mixed micro-structure including martensite and ferrite is obtained instead of a martensitic single-phase steel, causing a problem in that the presence of ferrite deteriorates the strength of the stainless steel. The present inventors have discovered that it is necessary to add Cu for the purpose of ensuring the strength even in the presence of ferrite. Further, the present inventors have discovered that it is necessary to add Mo for the purpose of ensuring the corrosion resistance of the stainless steel against a trace of hydrogen sulfide at normal temperature.

Additionally, the present inventors have discovered that the addition of Cu and Mo further decreases the Ms point, and hence it is necessary to limit the content of N and the content of Mn in the stainless steel for the purpose of ensuring the necessary high strength by increasing the Ms point.

The present invention has been perfected on the basis of the above-described findings, and the gist of the present invention is composed of the stainless steel pipes presented in the following (1) to (3). Hereinafter, the stainless steel pipes (1) to (3) are referred to as the aspects (1) to (3) of the present invention, respectively. These aspects are collectively referred to as the present invention, as the case may be.

(1) A high-strength stainless steel pipe excellent in sulfide stress cracking resistance and high-temperature carbonic-acid gas corrosion resistance, characterized in that: the stainless steel pipe consists of, by mass %, C: 0.05% or less, Si: 1.0% or less, P: 0.05% or less, S: less than 0.002%, Cr: more than 16% and 18% or less, Mo: more than 2% and 3% or less, Cu: 1% to 3.5%, Ni: 3% or more and less than 5%, Al: 0.001% to 0.1% and O: 0.01% or less, Mn: 1% or less and N: 0.05% or less, and Mn and N in the above ranges satisfy formula (I), and the balance being Fe and impurities; and the metal microstructure of the stainless steel pipe mainly includes a martensitic phase and includes 10 to 40% of a ferritic phase by volume fraction and 10% or less of a retained γ-phase by volume fraction.

$$[Mn]\times([N]-0.0045)\leq 0.001 \quad (1)$$

wherein the symbols of elements respectively represent the contents (unit: mass %) of the elements in the steel.

(2) The stainless steel pipe according to (1), characterized in that the stainless steel pipe further comprises, in place of a part of Fe, one or more of Ca: 0.01% or less and B: 0.01% or less.

(3) The stainless steel pipe according to (1) or (2), characterized in that the stainless steel pipe further comprises, in place of a part of Fe, one or more of V: 0.3% or less, Ti: 0.3% or less, Zr: 0.3% or less and Nb: 0.3% or less.

Advantage of the Invention

According to the present invention, a stainless steel pipe having a high strength and additionally being excellent in corrosion resistance can be provided, and the stainless steel pipe enables to perform, at an inexpensive cost, the production of crude oil or natural gas at a position further deeper than conventional positions. Therefore, the present invention is a high-value invention that contributes to stable global supply of energy.

BEST MODE FOR CARRYING OUT THE INVENTION

Hereinafter, the individual requirements for the stainless steel pipe of the present invention are described in detail. It is to be noted that, in the following descriptions, unless otherwise specified, the "%" representations of the contents of the individual elements mean the "mass %" values of the individual elements in the stainless steel.

1. Chemical Composition

C: 0.05% or less

When the content of C exceeds 0.05%, Cr carbide is precipitated at the time of tempering and hence the corrosion resistance against high-temperature carbonic acid gas is deteriorated. Accordingly, the content of C is set at 0.05% or less. From the viewpoint of the corrosion resistance, it is preferable to reduce the content of C, and the content of C is preferably 0.03% or less. The more preferable content of C is 0.01% or less.

Si: 1.0% or less

Si is an element that functions as a deoxidizer. When the content of Si exceeds 1%, the production amount of ferrite is increased, and no intended high strength comes to be obtained. Accordingly, the content of Si is set at 1.0% or less. The preferable content of Si is 0.5% or less. For the purpose of functioning as a deoxidizer, Si is preferably contained in a content of 0.05% or more.

P: 0.05% or less

P is an element that deteriorates the corrosion resistance against high-temperature carbonic acid gas. When the content of P exceeds 0.05%, the corrosion resistance is deteriorated, and hence the content of P is required to be reduced to 0.05% or less. The preferable content of P is 0.025% or less and the more preferable content of P is 0.015% or less.

S: less than 0.002%

S is an element that deteriorates the hot workability. In particular, the stainless steel according to the present invention takes, at the time of high-temperature hot working, a two-phase micro-structure composed of ferrite and austenite, and the adverse effect of S on the hot workability is significant. Therefore, for the purpose of obtaining a stainless steel pipe free from surface defects, the content of S is required to be reduced to less than 0.002%. The more preferable content of S is 0.001% or less.

Cr: more than 16% and 18% or less

Cr is an element that is necessary for ensuring the corrosion resistance against high-temperature carbonic acid gas. Through the synergetic effects with other corrosion resistance-improving elements, Cr suppresses the stress corrosion cracking in a high-temperature (for example, 200° C.) carbonic acid gas environment. For the purpose of sufficiently suppressing the stress corrosion cracking in the carbonic acid gas environment, the content of Cr more than 16% is required. Although the corrosion resistance in the carbonic acid gas environment is improved with the increase of the content of Cr, Cr has a function of increasing the amount of ferrite and deteriorating the strength, and hence it is necessary to impose a constraint on the content of Cr. Specifically, when the content of Cr exceeds 18%, the amount of ferrite is increased to drastically deteriorate the strength of the stainless steel, and hence the content of Cr is set at 18% or less. The preferable lower limit of Cr content is 16.5%, and the preferable upper limit is 17.8%.

Mo: more than 2% and 3% or less

When the production of crude oil (or gas) in an oil well (or a gas well) is temporarily suspended, the environmental temperature of the oil well (or the gas well) is decreased; in this case, when hydrogen sulfide is contained in the environment of the oil well (or the gas well), the sulfide stress corrosion cracking sensitivity of the stainless steel pipe presents a problem. In particular, a high-strength material is high in such sensitivity, and hence the corrosion resistance of the material to the sulfide stress cracking is important. Mo is an element that improves resistance to the sulfide stress cracking, and the content of Mo more than 2% is necessary for the purpose of ensuring a high strength and a satisfactory sulfide stress cracking resistance. On the other hand, Mo has a function of increasing the amount of ferrite and deteriorating the strength of the stainless steel, and hence the adding more than 3% of Mo is not preferable. Accordingly, the range of the content of Mo is set to exceed 2% and to be 3% or less. The preferable lower limit of Mo content is 2.2%, and the preferable upper limit is 2.8%.

Cu: 1% to 3.5%

In the stainless steel according to the present invention, the portion, which is austenite at a high temperature (at the time of hot working), is transformed into martensite at normal temperature, and thus, at normal temperature, the stainless steel becomes of a metal micro-structure mainly composed of the martensitic phase and the ferritic phase; however, for the purpose of ensuring the strength targeted by the present invention, the aging precipitation of the Cu phase is important. It is to be noted that when the content of Cu is less than 1%, the high strength is not sufficiently attained, and when the content of Cu exceeds 3.5%, the hot workability is deteriorated, and the production of the steel pipe becomes difficult. Accordingly, the range of the content of Cu is set at from 1% to 3.5%. The preferable lower limit of Cu content is 1.5% and the more preferable lower limit is 2.3%. The preferable upper limit of Cu content is 3.2% and the more preferable upper limit is 3.0%.

Ni: 3% or more and less than 5%

Ni is an element capable of improving the strength of stainless steel by stabilizing austenite at high temperatures and by increasing the amount of martensite at normal temperature. Further, Ni has a function of improving the corrosion resistance in a high-temperature environment, hence is an element desired to be added in a large content if such an addition is possible, and is required to be added in a content of 3.5% or more. However, when the content of Ni is increased, the function of decreasing the Ms point is large. Consequently, when Ni is added in a large content, despite cooling of the austenitic phase stable at high temperatures, the transformation into martensite does not occur and a large amount of γ-phase remains as the retained γ-phase at normal temperature. Herewith, the strength of the stainless steel is drastically deteriorated. However, a small amount of the retained γ-phase has a small effect on the strength deterioration of the stainless steel, and is preferable for the purpose of ensuring high toughness. For the purpose of not producing a large amount of the retained γ-phase even when Ni is added as much as possible, the reduction of the content of Mn or the content of N is effective. However, when the content of Ni is 5% or more, a large amount of the retained γ-phase is produced even under the reduction of the content of Mn or the content of N. Accordingly, the content of Ni is set at 3% or more and less than 5%. The preferable lower limit of Ni content is 3.6% and the more preferable lower limit is 4.0%. The preferable upper limit of Ni content is 4.9% and the more preferable upper limit is 4.8%.

Al: 0.001% to 0.1%

Al is an element that is necessary for deoxidization. When the content of Al is less than 0.001%, the effect of Al is not sufficient, and when the content of Al exceeds 0.1%, the amount of ferrite is increased to deteriorate the strength. Accordingly, the range of the content of Al is set at from 0.001% to 0.1%.

O (oxygen): 0.01% or less

O (oxygen) is an element that deteriorates the toughness and the corrosion resistance, and hence it is preferable to reduce the content of O. For the purpose of ensuring the toughness and corrosion resistance targeted by the present invention, it is necessary to set the content of O at 0.01% or less.

Mn: 1% or less

N: 0.05% or less $$[Mn]\times([N]-0.0045)\leq 0.001 \quad (1)$$

wherein the symbols of elements in formula (I) respectively represent the contents (unit: mass %) of the elements in the steel.

In the stainless steel pipe according to the present invention, the increase of the contents of Cr, Mo, Ni and Cu enables to improve the corrosion resistance; however, the addition of these elements in predetermined amounts or more decreases the Ms point and stabilizes the retained γ-phase. Consequently, the strength of the stainless steel pipe is drastically deteriorated. Accordingly, in the present invention, the ranges of the contents of Cr, Mo, Ni and Cu are defined as described above. Additionally, the present inventors have discovered that it is necessary to limit the content of Mn and the content of N for the purpose of sufficiently improving the strength of the stainless steel pipe while the respective contents of Cr, Mo, Ni and Cu are being limited within the above-described ranges.

Accordingly, the present inventors have examined in detail how the strength is varied when the content of Mn and the content of N are varied in a stainless steel in which the contents of Cr, Mo, Ni and Cu are respectively close to the upper limit values of the above-described ranges. Specifically, the present inventors have examined in detail how the strength is varied when the content of Mn and the content of N are varied in a stainless steel which contains C: 0.01%, Cr: 17.5%, Mo: 2.5%, Ni: 4.8% and Cu: 2.5%. The results thus obtained are shown in FIG. 1. It is to be noted that the stainless steel used for the examination was prepared by applying heating at 980° C. for 15 minutes, and subsequent quenching by water-cooling and subsequent tempering. In FIG. 1, the symbol O refers to the cases where a yield strength (yield stress: YS) of 861 MPa or more was ensured under the tempering conditions of 500° C. or higher and 30 minutes, and the symbol x refers to the cases where YS was less than 861 MPa even under the tempering conditions of 500° C. or higher and 30 minutes and even under the tempering conditions of lower than 500° C. and 30 minutes.

As shown in FIG. 1, the stainless steel having the above-described base composition has a yield strength of 861 MPa (125 ksi) or more when the stainless steel satisfies the above-described formula (I). Therefore, the present inventors limited the content of Mn and the content of N to the range satisfying above-described formula (I). Consequently, the strength of the stainless steel has been enabled to be sufficiently improved. It is to be noted that when the content of Mn exceeds 1%, the toughness is deteriorated, and hence the content of Mn is set at 1% or less irrespective of the content of N. On the other hand, when the content of N exceeds 0.05%, the precipitation of nitride of Cr is increased in amount to deteriorate the corrosion resistance, and hence the content of N is set at 0.05% or less irrespective of the content of Mn.

Ca: 0.01% or less

B: 0.01% or less

Ca and B are elements to be optionally added. At the time of production of a pipe by hot working, the stainless steel according to the present invention takes a two-phase micro-structure composed of ferrite and austenite, and hence depending on the hot working conditions, flaws and defects may be produced on the stainless steel pipe. When one or more of Ca and B are contained according to need for the purpose of solving this problem, working of a stainless steel pipe having a satisfactory surface condition becomes possible. However, when the content of Ca exceeds 0.01%, the amounts of inclusions are increased to deteriorate the toughness of the stainless steel pipe. Additionally, when the content of B exceeds 0.01%, carbo-borides of Cr are precipitated in the crystal grain boundary to deteriorate the toughness of the stainless steel pipe. Accordingly, the preferable contents of Ca and B are each set at 0.01% or less. It is to be noted that the above-described effects of Ca and B become remarkable when the content of Ca is 0.0003% or more, or when the content of B is 0.0002% or more. Accordingly, when one or more of Ca and B are included for the purpose of improving the pipe workability, the content of Ca is set more preferably in a range from 0.0003% to 0.01% and the content of B is set more preferably in a range from 0.0002% to 0.01%. In this connection, the upper limit of the total content of Ca and B is preferably 0.01% or less.

V, Ti, Zr, Nb: 0.3% or less

V, Ti, Zr and Nb are elements to be optionally added. The inclusion of one or more of V, Ti, Zr and Nb results in the production of carbo-nitrides in the stainless steel, and the precipitation effect and the grain refining effect improve the strength and the toughness. However, when the content of any of these elements exceeds 0.3%, coarse carbo-nitrides are increased in amount to deteriorate the toughness of the stainless steel. Accordingly, the preferable content of each of V, Ti, Zr and Nb is set at 0.3% or less. It is to be noted that the above-described effects of V, Ti, Zr and Nb become remarkable when the content of any of these elements is 0.003% or more. Accordingly, when one or more of V, Ti, Zr and Nb are included for the purpose of further improving the strength and the toughness of the stainless steel, it is more preferable to set the content of each of these elements in a range from 0.003% to 0.3%. In this connection, the upper limit of the total content of V, Ti, Zr and Nb is preferably 0.3% or less.

2. Metal Micro-Structure

Ferritic phase: 10% to 40%

When Ni is added in a range that causes no strength deterioration due to the decrease of the Ms point while the content of Cr and the content of Mo required to ensure satisfactory corrosion resistance of the stainless steel are being ensured, it is difficult to obtain a metal micro-structure composed of a martensitic single phase at normal temperature. Specifically, the metal micro-structure becomes, at normal temperature, a metal micro-structure that contains 10% or more of a ferritic phase by volume fraction. It is to be noted that when the content of the ferritic phase in the stainless steel exceeds 40% by volume fraction, it becomes difficult to ensure a high strength. Accordingly, the content of the ferritic phase is set at from 10 to 40% by volume fraction. It is to be noted that the volume fraction of the ferritic phase can be calculated, for example, by the method in which the ground stainless steel is subjected to etching with a mixed solution of aqua regia and glycerin, and then the area proportion of the ferritic phase is measured by the point counting method.

Retained γ-phase: 10% or less

A small amount of the retained γ-phase exerts only a small effect on the strength deterioration of the stainless steel and drastically improves the toughness. However, when the amount of the retained γ-phase is large, the strength of the stainless steel is drastically deteriorated. Accordingly, although the presence of the retained γ-phase is necessary, the upper limit value of the content of the retained γ-phase is set at 10% by volume fraction. The volume fraction of the retained γ-phase can be measured, for example, by an X-ray diffraction method. It is to be noted that for the purpose of improving the toughness of the stainless steel according to the present invention, the retained γ-phase is preferably present in a volume fraction of 1.0% or more.

Martensitic Phase

In the stainless steel according to the present invention, the metal micro-structure other than the ferritic phase and the retained γ-phase is mainly composed of the tempered martensitic phase. In the present invention, the martensitic phase is included in a volume fraction of 50% or more. It is to be noted that, in addition to the martensitic phase, carbides, nitrides, borides, Cu phases and the like may be present.

3. Production Method

The production method of the stainless steel pipe according to the present invention is not particularly limited and is only required to satisfy the above-described individual requirements. As an example of the production method of the stainless steel pipe, first, a billet of the stainless steel having the above-described alloy composition is produced. Next, a steel pipe is produced from the billet according to the process for producing a common seamless steel pipe. Subsequently, after the steel pipe has been cooled, a tempering treatment or a quenching-tempering treatment is performed. By performing the tempering treatment at 500° C. to 600° C., an intended high strength and an intended high toughness can be obtained through the production of an appropriate amount of the retained γ-phase and the simultaneous precipitation strengthening due to the Cu phase.

Next, the present invention is described more specifically with reference to Examples, but the present invention is not limited to these Examples.

EXAMPLES

From the steel types A to Z, a and b of stainless steel materials having the chemical compositions shown in Table 1, the stainless steel pipes of the sample Nos. 1 to 31 having the metal micro-structures shown in Table 2 were prepared. Specifically, each of the steel types A to Z, a and b of stainless steel materials was melted, and heated at 1250° C. for 2 hours; thereafter, by forging, a round billet was prepared for each of the steel types. Next, each of the round billets was maintained under heating at 1100° C. for 1 hour, and thereafter a stainless steel pipe of 125 mm in diameter and 10 mm in wall thickness was prepared by piercing with a piercing mill for laboratory use. Next, the outer and inner surfaces of each of the stainless steel pipes were ground to 1 mm by machining. Thereafter, each of the stainless steel pipes was heated at 980° C. to 1200° C. for 15 minutes and then water-cooled (quenching), and additionally, tempered at 500° C. to 650° C. to thereby regulate the metal micro-structure and the strength. The details of the quenching conditions and the tempering conditions for each of the stainless steel pipes are shown in Table 2. It is to be noted that for each of the steel types H, P and N, two different types of heat treatments were conducted, and thus two stainless steel pipes having different metal micro-structures (the sample Nos. 8, 14, 16, and 29 to 31 in Table 2) were prepared.

TABLE 1

| Steel | Chemical compositions (mass %, Balance: Fe and impurities) | | | | | | | | | | | | | |
|---|---|---|---|---|---|---|---|---|---|---|---|---|---|---|
| type | C | Si | Mn | P | S | Cr | Mo | Cu | Ni | sol. Al | N | O | Others | [Mn] × ([N] − 0.0045) |
| A | 0.008 | 0.16 | 0.27 | 0.009 | 0.0007 | 17.2 | 2.4 | 2.4 | 3.9 | 0.035 | 0.006 | 0.003 | — | 0.000405 |
| B | 0.004 | 0.43 | 0.28 | 0.011 | 0.0008 | 17.4 | 2.5 | 2.6 | 4.3 | 0.032 | 0.005 | 0.004 | — | 0.00014 |
| C | 0.025 | 0.06 | 0.13 | 0.011 | 0.0008 | 17.4 | 2.4 | 2.5 | 4.2 | 0.018 | 0.011 | 0.002 | — | 0.000845 |
| D | 0.011 | 0.41 | 0.14 | 0.012 | 0.0006 | 17.4 | 2.6 | 2.2 | 3.8 | 0.018 | 0.011 | 0.003 | — | 0.00091 |
| E | 0.008 | 0.21 | 0.13 | 0.011 | 0.0012 | 16.8 | 2.4 | 2.7 | 4.8 | 0.021 | 0.007 | 0.003 | — | 0.000325 |
| F | 0.017 | 0.20 | 0.14 | 0.010 | 0.0007 | 16.6 | 2.6 | 2.4 | 4.5 | 0.030 | 0.007 | 0.002 | — | 0.00035 |
| G | 0.029 | 0.39 | 0.23 | 0.008 | 0.0011 | 16.9 | 2.6 | 2.5 | 4.2 | 0.018 | 0.008 | 0.004 | B: 0.0009 | 0.000805 |
| H | 0.025 | 0.21 | 0.08 | 0.008 | 0.0008 | 17.2 | 2.6 | 2.4 | 3.6 | 0.029 | 0.013 | 0.003 | Ca: 0.0009, B: 0.0004 | 0.00068 |
| I | 0.015 | 0.04 | 0.11 | 0.010 | 0.0012 | 17.1 | 2.7 | 2.2 | 4.6 | 0.031 | 0.004 | 0.003 | Ca: 0.0020 | −0.000055 |
| J | 0.021 | 0.37 | 0.25 | 0.009 | 0.0012 | 16.7 | 2.4 | 2.3 | 4.0 | 0.035 | 0.003 | 0.003 | V: 0.05, Ti: 0.033, Ca: 0.0019 | −0.000375 |
| K | 0.014 | 0.43 | 0.21 | 0.008 | 0.0007 | 17.0 | 2.6 | 2.4 | 4.3 | 0.030 | 0.003 | 0.002 | V: 0.06, Ca: 0.0015 | −0.000315 |
| L | 0.024 | 0.28 | 0.07 | 0.008 | 0.0006 | 17.0 | 2.4 | 2.4 | 4.5 | 0.026 | 0.012 | 0.003 | Ti: 0.011, B: 0.0010 | 0.000525 |
| M | 0.023 | 0.50 | 0.07 | 0.010 | 0.0009 | 16.8 | 2.6 | 2.7 | 4.6 | 0.031 | 0.013 | 0.003 | V: 0.04, Ca: 0.0017 | 0.000595 |
| N | 0.007 | 0.17 | 0.12 | 0.012 | 0.0009 | 17.0 | 2.4 | 2.5 | 4.8 | 0.025 | 0.003 | 0.003 | V: 0.03, Ca: 0.0014 | −0.00018 |
| O | 0.021 | 0.34 | 0.09 | 0.009 | 0.0007 | 16.8 | 2.5 | 2.6 | 4.8 | 0.033 | 0.006 | 0.002 | V: 0.05, Ca: 0.0019 | 0.000135 |
| P | 0.009 | 0.12 | 0.22 | 0.010 | 0.0012 | 17.5 | 2.6 | 2.2 | 3.7 | 0.029 | 0.004 | 0.003 | Nb: 0.015, Zr: 0.032 | −0.00011 |
| Q | 0.005 | 0.27 | 0.14 | 0.009 | 0.0009 | 17.1 | 2.7 | 2.4 | 4.2 | 0.016 | 0.011 | 0.003 | V: 0.06 | 0.00091 |
| R | 0.014 | 0.45 | 0.11 | 0.010 | 0.0005 | 17.1 | 2.6 | 2.5 | 4.5 | 0.031 | 0.003 | 0.002 | V: 0.05 | −0.000165 |
| S | 0.021 | 0.38 | 0.28 | 0.008 | 0.0008 | 17.8 | 2.7 | 2.7 | 4.9 | 0.027 | 0.028 | 0.003 | V: 0.06, Ca: 0.0017 | *0.00658 |
| T | 0.019 | 0.29 | 0.84 | 0.010 | 0.0011 | 17.6 | 2.6 | 2.6 | 4.9 | 0.026 | 0.015 | 0.003 | V: 0.07, Ti: 0.008, | *0.00882 |
| U | 0.018 | 0.31 | 0.16 | 0.009 | 0.0009 | 17.7 | 2.7 | 2.6 | 4.9 | 0.025 | 0.033 | 0.002 | Ti: 0.013, Ca: 0.0012 | *0.00456 |
| V | 0.012 | 0.06 | 0.13 | *0.058 | 0.0005 | 16.7 | 2.6 | 2.4 | 4.7 | 0.022 | 0.004 | 0.002 | Ca: 0.0008 | −0.000065 |
| W | 0.024 | 0.38 | 0.23 | 0.010 | 0.0008 | *18.8 | 2.4 | 2.5 | 4.8 | 0.031 | 0.008 | 0.003 | Ca: 0.0013, V: 0.05 | 0.000805 |
| X | 0.021 | 0.28 | 0.09 | 0.011 | 0.0006 | 17.8 | 2.5 | 2.4 | *5.7 | 0.016 | 0.012 | 0.003 | Ca: 0.0015, V: 0.04, B: 0.0012 | 0.000675 |

TABLE 1-continued

| Steel type | Chemical compositions (mass %, Balance: Fe and impurities) C | Si | Mn | P | S | Cr | Mo | Cu | Ni | sol. Al | N | O | Others | [Mn] × ([N] − 0.0045) |
|---|---|---|---|---|---|---|---|---|---|---|---|---|---|---|
| Y | 0.024 | 0.20 | 0.08 | 0.009 | 0.0006 | *15.4 | 2.2 | 2.2 | 3.9 | 0.029 | 0.005 | 0.004 | Ca: 0.0013, V: 0.05 | 0.00004 |
| Z | 0.021 | 0.16 | 0.28 | 0.010 | 0.0010 | 17.5 | *1.6 | 2.5 | 3.6 | 0.024 | 0.006 | 0.003 | V: 0.04, Ti: 0.028 | 0.00042 |
| a | 0.021 | 0.12 | 0.13 | 0.012 | 0.0006 | 17.5 | 2.5 | *0.6 | 3.9 | 0.028 | 0.012 | 0.004 | Ti: 0.013 | 0.000975 |
| b | 0.022 | 0.43 | 0.09 | 0.011 | 0.0006 | 16.8 | 2.6 | 2.5 | *2.3 | 0.016 | 0.007 | 0.002 | Nb: 0.031, Ti: 0.024 | 0.000225 |

Symbol "*" means the deviation from the conditions defined in the present invention.

TABLE 2

| | Sample No. | Steel type | Ferritic phase, Volume fraction (%) | Retained γ-phase, Volume fraction (%) | Yield strength (MPa) | Stress corrosion cracking test in carbonic acid gas environment | Sulfide Stress cracking test | Quenching conditions: Quenching temperature (° C.) | Quenching conditions: Water-cooling time (min) | Tempering conditions: Tempering temperature (° C.) | Tempering conditions: Air-cooling time (min) |
|---|---|---|---|---|---|---|---|---|---|---|---|
| Examples | 1 | A | 33 | 3.1 | 896 | ○○○ | ○○○ | 980 | 15 | 540 | 30 |
| | 2 | B | 32 | 5.6 | 882 | ○○○ | ○○○ | 980 | 15 | 540 | 30 |
| | 3 | C | 25 | 4.9 | 916 | ○○○ | ○○○ | 980 | 15 | 530 | 30 |
| | 4 | D | 39 | 3.5 | 875 | ○○○ | ○○○ | 980 | 15 | 580 | 30 |
| | 5 | E | 11 | 5.7 | 958 | ○○○ | ○○○ | 980 | 15 | 500 | 30 |
| | 6 | F | 17 | 4.2 | 944 | ○○○ | ○○○ | 980 | 15 | 520 | 30 |
| | 7 | G | 23 | 4.0 | 930 | ○○○ | ○○○ | 980 | 15 | 530 | 30 |
| | 8 | H | 38 | 2.5 | 889 | ○○○ | ○○○ | 980 | 15 | 570 | 30 |
| | 9 | I | 24 | 5.9 | 909 | ○○○ | ○○○ | 980 | 15 | 550 | 30 |
| | 10 | J | 26 | 2.0 | 930 | ○○○ | ○○○ | 980 | 15 | 540 | 30 |
| | 11 | K | 27 | 4.5 | 909 | ○○○ | ○○○ | 980 | 15 | 550 | 30 |
| | 12 | L | 18 | 4.7 | 937 | ○○○ | ○○○ | 980 | 15 | 520 | 30 |
| | 13 | M | 16 | 5.5 | 944 | ○○○ | ○○○ | 980 | 15 | 510 | 30 |
| | 14 | N | 18 | 6.0 | 930 | ○○○ | ○○○ | 980 | 15 | 520 | 30 |
| | 15 | O | 13 | 5.8 | 951 | ○○○ | ○○○ | 980 | 15 | 540 | 30 |
| | 16 | P | 39 | 3.4 | 875 | ○○○ | ○○○ | 980 | 15 | 600 | 30 |
| | 17 | Q | 30 | 4.7 | 896 | ○○○ | ○○○ | 980 | 15 | 550 | 30 |
| | 18 | R | 25 | 5.7 | 909 | ○○○ | ○○○ | 980 | 15 | 540 | 30 |
| Comparative Examples | 19 | S | 18 | *36.4 | 579 | — | — | 980 | 15 | 580 | 30 |
| | 20 | T | 21 | *33.3 | 593 | — | — | 980 | 15 | 580 | 30 |
| | 21 | U | 19 | *32.6 | 582 | — | — | 980 | 15 | 580 | 30 |
| | 22 | V | 15 | 5.2 | 944 | XXX | ○○X | 980 | 15 | 520 | 30 |
| | 23 | W | 34 | *51.6 | 501 | — | — | 980 | 15 | 580 | 30 |
| | 24 | X | *7 | *77.3 | 438 | — | — | 980 | 15 | 590 | 30 |
| | 25 | Y | *8 | *0 | 1006 | ○XX | ○○X | 980 | 15 | 510 | 30 |
| | 26 | Z | 31 | 0.9 | 923 | ○XX | XXX | 980 | 15 | 530 | 30 |
| | 27 | a | 40 | 1.8 | 723 | — | — | 980 | 15 | 560 | 30 |
| | 28 | b | *63 | *0 | 737 | — | — | 980 | 15 | 560 | 30 |
| | 29 | H | *58 | 1.8 | 751 | — | — | 1200 | 15 | 560 | 30 |
| | 30 | P | *63 | 3.0 | 675 | — | — | 1200 | 15 | 560 | 30 |
| | 31 | N | 11 | *13.5 | 696 | — | — | 980 | 15 | 650 | 30 |

Symbol "*" means the deviation from the conditions defined in the present invention.

The steel types A to R in Table 1 are the stainless steel materials in each of which the chemical composition was within the ranges defined in the present invention. On the other hand, the steel types S to Z, a and b are the stainless steel materials of Comparative Examples in each of which the chemical composition deviated from the ranges defined in the present invention.

Additionally, in Table 2, the stainless steel pipes of the sample Nos. 1 to 18 are the stainless steel pipes of Examples in each of which the chemical composition and the metal micro-structure were within the ranges defined in the present invention, and the stainless steel pipes of the sample Nos. 19 to 31 are the stainless steel pipes of Comparative Examples in each of which the chemical composition or the metal micro-structure deviated from the ranges defined in the present invention.

It is to be noted that, in Table 2, the volume fraction of the ferritic phase were calculated by the method in which each of the ground stainless steels (specimens) was subjected to etching with a mixed solution of aqua regia and glycerin, and then the area proportion of the ferritic phase was measured by the point counting method. Additionally, the volume fraction of the retained γ-phase was measured with an X-ray diffraction method. In Table 2, the results of the below-described tensile test and four-point bending corrosion test are also shown.

From the stainless steel pipes prepared as described above, the specimens for performing the tensile test and the four-point bending corrosion test were sampled. As the tensile test specimens, round rod tensile test specimens each having a diameter of 4 mm and a length of 20 mm in the parallel portion were sampled along the lengthwise direction of each of the stainless steel pipes. The tensile test was performed at normal temperature, and the yield strength (yield stress) was measured.

As the four-point bending corrosion test, the stress corrosion cracking test in a high-temperature carbonic acid gas environment and the sulfide stress cracking test in an environment of a trace of hydrogen sulfide were performed. Each of the four-point bending tests was performed according to the following guidelines. It is to be noted that the four-point bending test was performed for the specimens of the sample Nos. 1 to 18, 22, and 26 (see Table 2).

(Implementation Guidelines of Bending Test in a High-Temperature Carbonic Acid Gas Environment)

Specimens: Three specimens (width: 10 mm, thickness: 2 mm, length: 75 mm) for the four-point bending test were sampled from each of the numbered samples.

Applied stress: A value of 100% of the yield stress (the yield stress of each of the specimens obtained from the same stainless steel pipes: see Table 2) obtained in the tensile test was applied according to the ASTM-G39 specifications by controlling the deflection amount.

Test environment: $CO_2$ at 3 MPa (30 bar), aqueous solution of NaCl having a concentration of 25%, 200° C.

Test time: 720 hours.

Evaluation: The four-point bending test was performed for each of the specimens under the above-described conditions, and the occurrence-nonoccurrence of the cracking was evaluated. In Table 2, the symbol "O" represents the nonoccurrence of cracking, and the symbol "x" represents the occurrence of cracking. For example, in the stainless steel of the sample No. 22, all the specimens (3 pieces) underwent the occurrence of cracking, and hence the sample No. 22 is marked with "xxx."

(Implementation Guidelines of Bending Test in an Environment of a Trace of Hydrogen Sulfide)

Specimens: Three specimens (width: 10 mm, thickness: 2 mm, length: 75 mm) for the four-point bending test were sampled from each of the numbered samples.

Applied stress: A value of 100% of the yield stress (the yield stress of each of the specimens obtained from the same stainless steel pipes: see Table 2) obtained in the tensile test was applied according to the ASTM-G39 specifications by controlling the deflection amount.

Test environment: Gas at 0.1 MPa (1 bar) composed of $H_2S$ at 0.001 MPa (0.01 bar) and the balance ($CO_2$), aqueous solution of NaCl having a concentration of 20%+an aqueous solution of $NaHCO_3$ having a concentration of 21 mg/L, 25° C. and pH4.

Test time: 336 hours.

Evaluation: The four-point bending test was performed for each of the specimens under the above-described conditions, and the occurrence-nonoccurrence of the cracking was evaluated. In Table 2, the symbol "O" represents the nonoccurrence of cracking, and the symbol "x" represents the occurrence of cracking. For example, in the stainless steel of the sample No. 22, two pieces of the three specimens underwent the nonoccurrence of cracking, and one piece of the three specimens underwent the occurrence of cracking, and hence the sample No. 22 is marked with "OOx."

First, the discussion starts from the results of the tensile test. As shown in Table 2, in each of the stainless steels of the sample Nos. 1 to 18 which are Examples of the present invention, a high yield strength (yield stress) of 861 MPa (125 ksi) or more was obtained. On the other hand, in the stainless steels (see the steel types S to U in Table 1) of the sample Nos. 19 to 21 in each of which the content of N and the content of Mn deviated from the ranges defined by the present invention (the ranges satisfying formula (1)), the Ms point was decreased and the retained γ-phase was thereby remarkably increased. Consequently, no sufficient yield strength was obtained in each of the stainless steels of the sample Nos. 19 to 21.

Also, in each of the stainless steel (see the steel type W in Table 1) of the sample No. 23 in which the content of Cr exceeded the defined range of the present invention and the stainless steel (see the steel type X in Table 1) of the sample No. 24 in which the content of Ni exceeded the defined range of the present invention, the retained γ-phase was remarkably increased due to the decrease of the Ms point, and consequently, no sufficient yield strength was obtained.

Also, in the stainless steel (see the steel type a in Table 1) of the sample No. 27 in which the content of Cu was less than the defined range of the present invention, the strength increase due to the precipitation strengthening was not sufficient, and no sufficient yield strength was obtained. Also, in the stainless steel (see the steel type b in Table 1) of the sample No. 28 in which the content of Ni was less than the defined range of the present invention, the ferritic phase was increased in amount, and consequently no sufficient yield strength was obtained.

Also, in the stainless steels of the sample Nos. 29 to 31 in each of which the chemical composition was within the defined range of the present invention, but the metal microstructure (the volume fraction of the ferritic phase or the volume fraction of the retained γ-phase) deviated from the defined range of the present invention, no sufficient strengths were obtained. It is to be noted that in the sample Nos. 29 and 30, the quenching temperature was 1200° C. and the quenching was performed from the region where the δ-ferrite was stable. It is inferred that consequently the content of ferrite was increased. Also, in the sample No. 30, the tempering temperature was the ferrite-austenite two-phase region temperature, and consequently, the retained austenite was increased in amount. From this fact, it is seen that the regulation of the metal micro-structure of the stainless steel carried out through heat treatment so that the metal micro-structure falls within the range of the present invention improves the yield strength.

Next, the results of the four-point bending test are discussed. The four-point bending test was performed for the stainless steels of the sample Nos. 1 to 18 which are Examples of the present invention and was performed for the stainless steels of the sample Nos. 22, 25 and 26, for each of which a predetermined strength had been obtained, of the stainless steels of Comparative Examples.

As shown in Table 2, in each of the stainless steels of the sample Nos. 1 to 18 which are Examples of the present invention, no cracking occurred in the stress corrosion cracking test in the high-temperature carbonic acid gas environment and in the sulfide stress cracking test in the environment of a trace of hydrogen sulfide. From this fact, it has been verified that each of the stainless steels of the sample Nos. 1 to 18 which are Examples of the present invention has a high strength and additionally, an excellent corrosion resistance capable of sufficiently preventing the stress corrosion cracking in the high-temperature carbonic acid gas and the sulfide stress cracking at normal temperature.

On the other hand, in the stainless steel (see the steel type V in Table 1) of the sample No. 22 in which the content of P exceeded the defined range of the present invention, cracking occurred in the four-point bending test. From this fact, it is seen that the stainless steel of the sample No. 22 is inferior in corrosion resistance to the stainless steels according to the present invention. In particular, in the four-point bending test in the high-temperature carbonic acid gas, the stainless steel of the sample No. 22 underwent the occurrence of cracking in two specimens, and hence it is seen that the stress corrosion cracking sensitivity of the stainless steel of the sample No. 22 at high temperatures was enhanced.

Also, in each of the stainless steel (see the steel type Y in Table 1) of the sample No. 25 in which the content of Cr was less than the defined range of the present invention and the stainless steel (see the steel type Z in Table 1) of the sample No. 26 in which the content of Mo was less than the defined range of the present invention, cracking occurred in the four-point bending test. From this fact, it is seen that a shortage of the content of Cr or the content of Mo deteriorates the corrosion resistance.

Although only some exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention.

INDUSTRIAL APPLICABILITY

The stainless steel pipe according to the present invention can be suitably used in various oil wells and gas wells.

BRIEF DESCRIPTION OF THE DRAWING

FIG. 1 is a graph showing the strength variation observed when the content of Mn and the content of N were varied in a stainless steel having a base composition of C: 0.01%, Cr: 17.5%, Mo: 2.5%, Ni: 4.8% and Cu: 2.5%.

The invention claimed is:

1. A high-strength stainless steel pipe excellent in sulfide stress cracking resistance and high-temperature carbonic-acid gas corrosion resistance and having a yield strength of 758 MPa or more, characterized in that:

the stainless steel pipe consists of, by mass %, C: 0.05% or less, Si: 1.0% or less, P: 0.05% or less, S: less than 0.002%, Cr: more than 16% and 18% or less, Mo: more than 2% and 3% or less, Cu: 2.2% to 3.5%, Ni: 3% or more and less than 5%, Al: 0.001% to 0.1% and O: 0.01% or less, Mn: 1% or less and N: 0.05% or less, and Mn and N in the above ranges satisfy formula (I), and the balance being Fe and impurities; and the metal micro-structure of the stainless steel pipe mainly comprises a martensitic phase and comprises 10 to 40% of a ferritic phase by volume fraction and 10% or less of a retained γ-phase by volume fraction; and $$[Mn]\times([N]-0.0045)\leq 0.001 \quad (1)$$

wherein the symbols of elements respectively represent the contents (unit: mass %) of the elements in the steel.

2. The stainless steel pipe according to claim 1, characterized in that the stainless steel pipe further comprises, in place of a part of Fe, one or more of Ca: 0.01% or less and B: 0.01% or less.

3. The stainless steel pipe according to claim 1, characterized in that the stainless steel pipe further comprises, in place of a part of Fe, one or more of V: 0.3% or less, Ti: 0.3% or less, Zr: 0.3% or less and Nb: 0.3% or less.

4. The stainless steel pipe according to claim 2, characterized in that the stainless steel pipe further comprises, in place of a part of Fe, one or more of V: 0.3% or less, Ti: 0.3% or less, Zr: 0.3% or less and Nb: 0.3% or less.

* * * * *